US009835031B2

(12) United States Patent
Nelson

(10) Patent No.: US 9,835,031 B2
(45) Date of Patent: Dec. 5, 2017

(54) REVERSIBLE PNEUMATIC VANE MOTOR

(71) Applicant: ATLAS COPCO INDUSTRIAL TECHNIQUE AB, Stockholm (SE)

(72) Inventor: Anders Urban Nelson, Alsvsjo (SE)

(73) Assignee: ATLAS COPCO INDUSTRIAL TECHNIQUE AB, Stockholm (SE)

( * ) Notice: Subject to any disclaimer, the term of this patent is extended or adjusted under 35 U.S.C. 154(b) by 44 days.

(21) Appl. No.: 14/404,351

(22) PCT Filed: May 29, 2013

(86) PCT No.: PCT/EP2013/061002
§ 371 (c)(1),
(2) Date: Nov. 26, 2014

(87) PCT Pub. No.: WO2013/178646
PCT Pub. Date: Dec. 5, 2013

(65) Prior Publication Data

US 2015/0147212 A1 May 28, 2015

(30) Foreign Application Priority Data

Jun. 1, 2012 (SE) ..... 1250572

(51) Int. Cl.
*F03C 2/00* (2006.01)
*F03C 4/00* (2006.01)
(Continued)

(52) U.S. Cl.
CPC ..... *F01C 20/04* (2013.01); *F01C 1/3442* (2013.01); *F01C 13/02* (2013.01); *F01C 20/14* (2013.01); *F01C 21/186* (2013.01)

(58) Field of Classification Search
CPC ..... F01C 1/3442; F01C 13/02; F01C 20/04; F01C 20/14; F01C 21/186
(Continued)

(56) References Cited

U.S. PATENT DOCUMENTS 2,077,733 A 4/1937 Amtsberg
2,159,232 A * 5/1939 Shaff ..... B25B 21/00 181/230
(Continued)

FOREIGN PATENT DOCUMENTS

DE 415473 C 6/1925
EP 0832721 A1 4/1998

OTHER PUBLICATIONS

International Search Report (ISR) dated Jun. 3, 2014 issued in International Application No. PCT/EP2013/061002.

*Primary Examiner* — Mark Laurenzi
*Assistant Examiner* — Deming Wan
(74) *Attorney, Agent, or Firm* — Holtz, Holtz & Volek PC

(57) ABSTRACT

A reversible pneumatic vane motor includes a stator housing with a pressure air inlet passage and an exhaust air outlet passage, a cylinder supported in the stator housing, a vane carrying rotor rotatable in the cylinder and forming a clearance seal portion with the cylinder, air communication ports located at opposite sides of the seal portion for supplying motive pressure air or scavenging exhaust air from the cylinder, a primary outlet diametrically opposite the clearance seal portion, and a directional valve for connecting alternatively the air communication ports to the pressure air inlet passage and the exhaust air outlet passage. The motor also includes auxiliary outlet ports which are located between the primary outlet and each one of the air communication ports, and the directional valve includes control parts for opening up and closing, respectively, communication between the auxiliary outlet ports and the atmosphere via the exhaust air outlet passage.

4 Claims, 3 Drawing Sheets

(51) Int. Cl.

| | |
|---|---|
| ***F04C 2/344*** | (2006.01) |
| ***F04C 18/344*** | (2006.01) |
| ***F01C 21/18*** | (2006.01) |
| ***F04C 28/04*** | (2006.01) |
| ***F01C 20/04*** | (2006.01) |
| ***F01C 1/344*** | (2006.01) |
| ***F01C 13/02*** | (2006.01) |
| ***F01C 20/14*** | (2006.01) |

(58) Field of Classification Search
USPC ..... 418/32, 270, 268, 15, 295; 417/315; 181/230
See application file for complete search history.

(56) References Cited

U.S. PATENT DOCUMENTS

| | | | | |
|---|---|---|---|---|
| 2,463,155 | A | 3/1949 | Dawes | |
| 3,752,241 | A * | 8/1973 | Bent | A61B 17/1626 173/221 |
| 4,344,746 | A | 8/1982 | Leonard | |
| 6,401,836 | B1 * | 6/2002 | Heinrichs | B25F 5/001 173/168 |
| 2006/0075989 | A1 | 4/2006 | Barth et al. | |
| 2007/0217940 | A1 | 9/2007 | Chang | |

* cited by examiner

REVERSIBLE PNEUMATIC VANE MOTOR

The invention relates to a reversible pneumatic vane motor having a stator housing with a cylinder, a vane carrying rotor rotatable in the cylinder and forming a clearance seal portion relative to the cylinder wall, wherein the stator housing has air communication ports located at both sides of the clearance seal portion for supplying motive pressure air and scavenging exhaust air from the cylinder at alternative directions of rotation, and a primary outlet is provided at a location diametrically opposite the clearance seal portion for draining exhaust air from the cylinder in both directions of rotation. A directional valve is provided for alternative connection of the air communication ports to a pressure air source and the atmosphere at alternative directions of motor rotation.

The above described reversible type of pneumatic vane motor has its primary outlet at an angular location diametrically opposite the clearance seal portion to make the motor operate at equal efficiency in both directions of rotation. In comparison with a vane motor designed for a one way operation with an asymmetrically located primary outlet the efficiency of the reversible motor is considerably lower. This is due to the symmetric location of the primary outlet of the latter, which will cause a slight recompression of the exhaust air that was not able to leave the cylinder through the primary outlet. This recompression causes a reduced power outlet of the reversible type of motor.

A further problem with the prior art type of reversible motor is that it tends to generate a higher noise level since there are limited possibilities to optimize the design of the primary outlet.

A prior art pneumatic tool is described in U.S. 2007/0217940. This tool is arranged to provide a high torque in a first direction (slackening mode) and a small torque in the opposite direction (tightening mode). A problem with this arrangement is however that is inefficient in the tightening mode. Namely, in most applications it is desired to provide a high torque in both directions.

It is an object of the invention to provide an improved reversible pneumatic vane motor having an increased power output and an increased idle speed operation in both directions of rotation.

It is a further object of the invention to create a reversible vane motor providing a greater flexibility for noise attenuation by a enabling a balanced exhaust outlet design.

It is a still further object of the invention to provide an improved reversible pneumatic vane motor having a stator housing and cylinder provided with air communication ports and a primary outlet symmetrically located relative to the clearance seal portion, and comprising means for preventing recompression of exhaust air.

Further objects and advantages of a pneumatic vane motor according to the invention will appear from the following specification and claims.

A preferred embodiment of the invention is described below with reference to the accompanying drawings.

In the drawings

Figure 1:
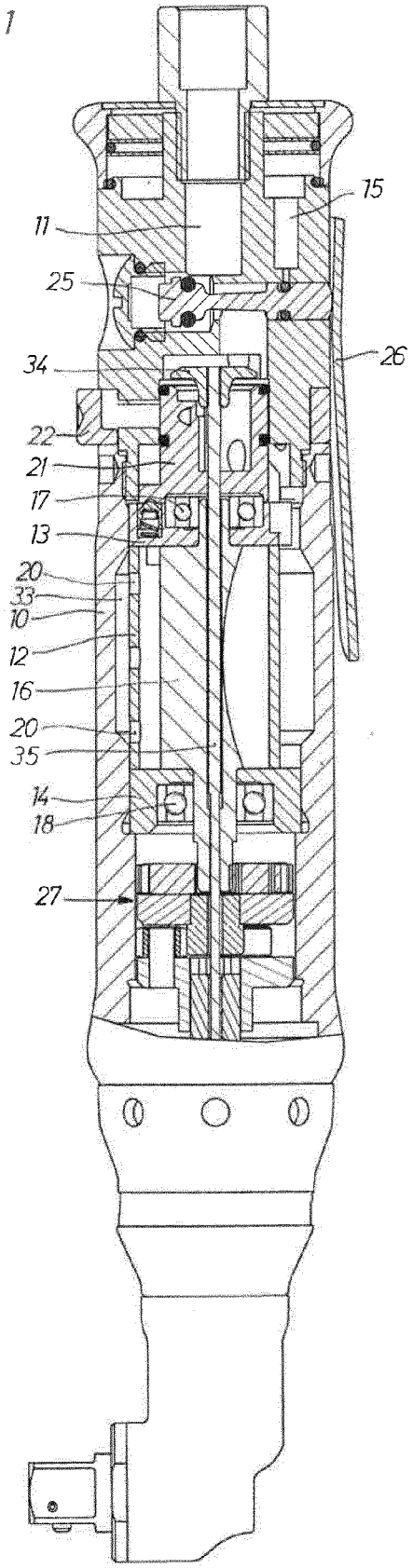
FIG. 1 shows a side view, partly in section, of a reversible vane motor according to the invention in a power nutrunner application.
Figure 2:
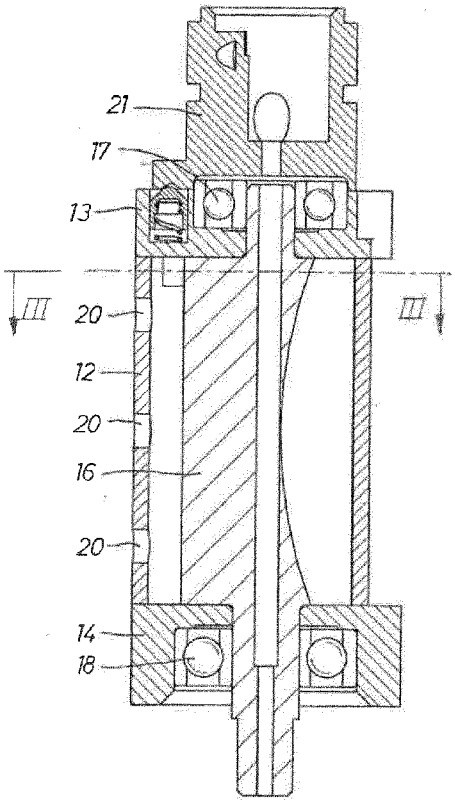
FIG. 2 shows a longitudinal section through a vane motor according to the invention.
Figure 4A:
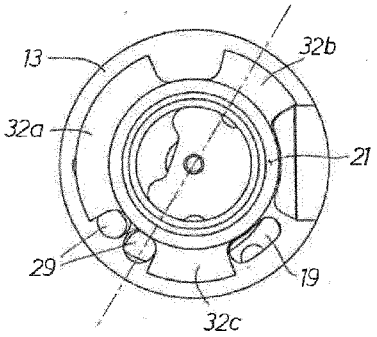

FIG. 4*a* shows a rear end view of the motor as shown in FIG. 2 with the directional valve in one of its operational positions.

Figure 4B:
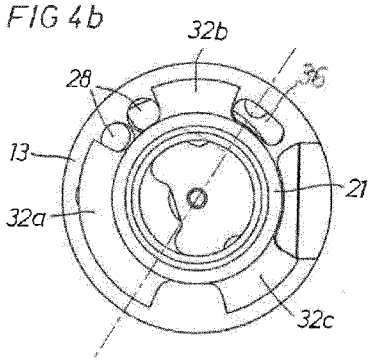

FIG. 4*b* shows the same end view as in FIG. 4*a*, but illustrating the directional valve in an alternative operational position.

Figure 5A:
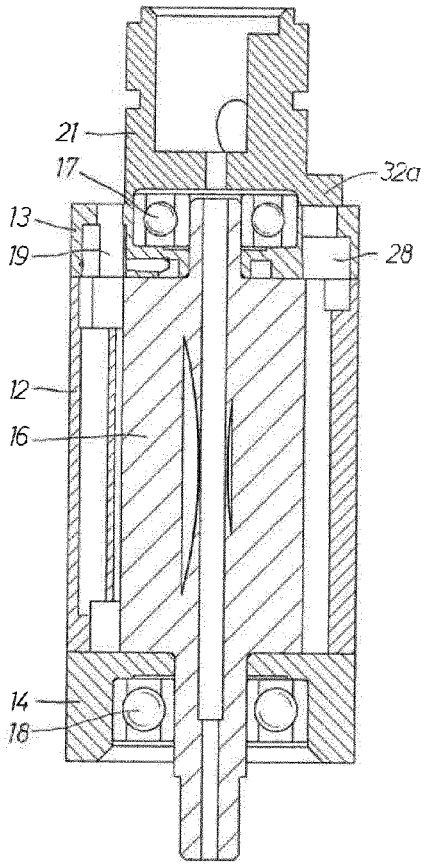

FIG. 5*a* shows a longitudinal section through the motor and illustrates the directional valve in a position wherein one of the air communication ports is connected to the outlet passage whereas one of the auxiliary ports is closed.

Figure 5B:
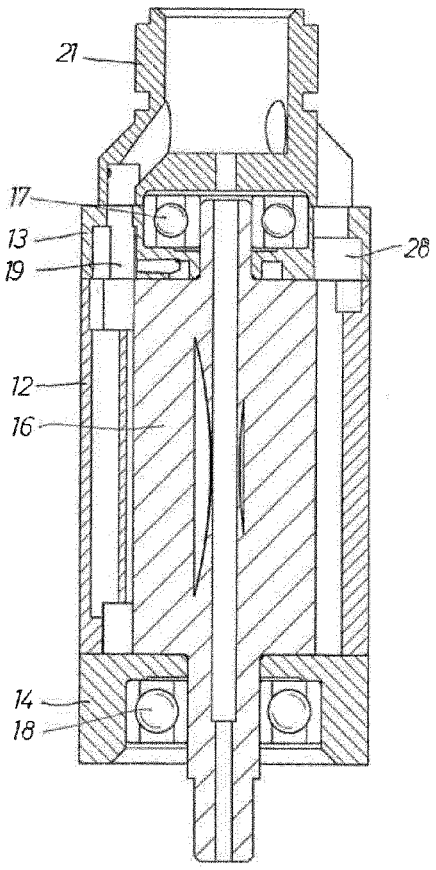

FIG. 5*b* shows the same view as FIG. 5*a* but illustrating the directional valve in another position wherein the same air communication port is connected to the pressure air inlet whereas the auxiliary port is open to the outlet passage.

The motor shown in the drawing figures is a reversible vane motor comprising the features of the invention. The illustrated motor is incorporated in a pneumatic hand held power nutrunner where a reversible motor is desirable. The motor comprises a stator housing 10 which is formed integral with the nutrunner housing and which has a pressure inlet passage 11 and an exhaust air outlet passage 15. The inlet passage 11 is controlled by a throttle valve 25 which is maneuverable by a lever 26 supported on the stator housing 10. Moreover, in the stator housing 10 there is mounted a cylinder 12 with two end walls 13, 14, and a rotor 16 carrying a number of vanes 23 *a-e* which define a number of cells 24 *a-e*. The rotor 16 is rotatable in the cylinder 12 and supported in bearings 17, 18 in the end walls 13, 14. In a conventional way the rotor 16 is disposed excentrically relative to the stator housing 10 and forms a clearance seal portion 37 relative to the cylinder 12. In a way conventional to this type of nutrunners, the rotor 16 is connected to the output end of the nutrunner via reduction gearing 27 and a non-illustrated torque responsive release clutch which is connected to an automatic shut-off valve 34 via rod 35 extending through the rotor centre.

Figure 3:
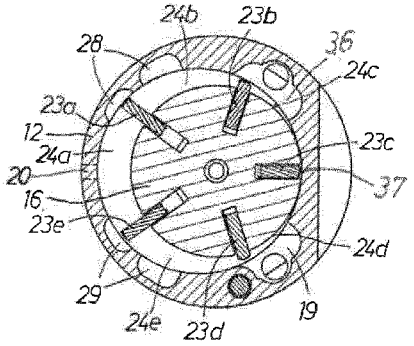
FIG. 3 shows a cross section along line in FIG. 2.

In one of the cylinder end wall 13 there is provided two air communication ports 36, 19 located at opposite sides of the seal portion 37 and intended for alternative supply of motive air and scavange of exhaust air from the cylinder at alternative directions of rotor rotation. See FIG. 3. Diametrically opposite the seal portion 37 the cylinder 11 is provided with a constantly open primary exhaust air outlet 20 comprising a number of openings in the cylinder 12 and communicating with an exhaust chamber 33. The above described features are well known in prior art reversible vane motors, which means that the symmetrically located air communication ports 36, 19 and primary outlet 20 give equal power output and idle speed of the motor in both directions of rotation.

A directional valve 21 is rotatively supported at the rear end wall 13 and shiftable between two active positions by a lever 22. In one of these positions the valve 21 is arranged to duct pressure air from the air inlet passage 11 to one of the air communication ports 36, and, at the same time, open up the other one of the air communication ports 19 for scavange outlet to the atmosphere via the exhaust air outlet passage 15. In the other position the directional valve 21 switches the air supply to the other air communication port 19, whereas the first mentioned air communication port 36 is opened for scavange outlet to the atmosphere. Accordingly, the motor rotation may be altered between alternative directions by the directional valve 21.

A drawback inherent in this type of motor is that when the leading vane 23*a* of one pressurized cells 24*a* on the rotor 16 has passed the primary outlet 20 this cell 24*a* is drained through the primary outlet 20. However, as the trailing vane 23*b* of this cell 24*a* has passed the primary outlet 20 the cell 24*a* will get smaller in size at continued rotation of the rotor 16, and the air which has not managed to escape through the primary outlet 20 and which is still entrapped in the cell 24*a* will be recompressed to some extent until the leading vane 23*a* passes the scavange functioning air communication port 19. This recompression of the entrapped air volume causes a certain resistance to the rotor operation and, hence, an undesirable reduction in power output.

In order to avoid such a power loss due to recompression of entrapped exhaust air the motor according to the invention is provided with auxiliary outlet ports 28, 29 located at opposite sides of the primary outlet 20 at angular positions between the primary outlet 20 and the air communication ports 36, 19. These auxiliary outlet ports 28, 29 comprise two openings each and are individually controlled by the directional valve 21 such that the correct auxiliary outlet port is open for a certain direction of rotation. For that purpose, the directional valve 21 is provided with control members 32*a*, 32*b*, 32*c* which are arranged to alternatively block or uncover not only the air communication ports 36, 19 but also the auxiliary outlet ports 28, 29 owing to the actual angular position of the valve 21.

For instance, in one of the directional valve 21 positions the auxiliary outlet port 28 which is located at an angular position between the primary outlet 20 and the air communication port 36 is opened to the atmosphere at the same time as the latter is also open to the atmosphere via the exhaust air outlet passage 15, whereas the other auxiliary outlet port 29 is closed. This means that the angular distance for a travelling cell between the auxiliary outlet port 28 and the scavange point at the air communication port 36 is very short and that recompression of the air entrapped in the cell is substantially avoided. This means a considerably less resistance to the rotor operation and, hence, a higher idle speed and an increased power output.

In the other position of the directional valve 21 the auxiliary outlet port 29 located between the primary outlet 20 and the air communication port 19 is opened at the same time as the latter is also open to scavange exhaust air, whereas the auxiliary outlet port 28 is closed. This makes the motor rotate in the opposite direction with the same operational features and power output as in the first described direction. This means that the motor is able to operate with the same operational characteristics in both directions, as in a prior art motor, but at a considerably higher power output and idle speed in both directions.

In FIG. 5*a* the directional valve 21 is illustrated in a position wherein the air communication port 19 is connected to the atmosphere via the outlet passage, whereas the auxiliary outlet port 28 is closed by a control member 32*a* of the valve 21, and in FIG. 5*b* the directional valve 21 is illustrated in its opposite position wherein the air communication port 19 is connected to the pressure air inlet passage 11 and the auxiliary outlet port 28 is open to the outlet passage 15.

In operation of the motor in a clockwise rotation the auxiliary outlet port 29 is closed, whereas the auxiliary outlet port 28 is open. During rotation of the rotor 12 drainage of a travelling cell 24*a* starts as before with exhaust air leaving through the primary outlet 20 as the leading vane 23*a* has passed the latter, but before the trailing vane 23*e* has passed the primary outlet 20 the leading vane 23*a* now passes the auxiliary outlet port 28, which means that the cell 24*a* is still connected to the outlet passage 15 and the atmosphere. Since the distance between the auxiliary outlet port 28 and the scavenging air communication port 19 is very short there will be no closure of the cell 24*a* and consequently no recompression of the exhaust air in the cell. The above operation order is the same for all of the vane defined cells 24 *a-e* on the rotor 12.

In the anticlockwise rotation direction of the rotor 12 the auxiliary outlet port 29 is open and the auxiliary outlet port 28 is closed. The leading vane of the cell 24*a* will be vane 23*e*, whereas the vane 23*a* will be the trailing vane, and draining of the cell 24*a* starts as the leading vane 23*e* passes the primary outlet 20. As in the above case, the leading vane 23*e* has reached and passes the open auxiliary outlet port 29 before the trailing vane 23*a* has reached the primary outlet 20, such that the cell 24*a* will remain connected to the outlet passage 15. This means that the exhaust air in the cell 24*a* will not be recompressed as the volume of the cell 24*a* diminishes.

By the invention it is possible to increase the power of a reversible pneumatic vane motor without increasing the size of the motor. That is particularly important in power tool applications where the overall size and weight of the tool is crucial.

It is to be noted that the invention is not limited to the shown and described example but may be freely varied within the scope of the claims. For instance, the exact location and design of the auxiliary outlet ports 28, 29 could be varied and adapted to get the most favorable tuning of the motor. Location and size of the auxiliary outlet ports 28, 29 may also be varied depending on the number of vanes and cells on the rotor. The fewer the vanes the larger the cells.

The invention claimed is:

1. A reversible pneumatic vane motor, comprising:

a stator housing with a pressure air inlet passage and an exhaust air outlet passage, a cylinder having opposite end walls and being supported in the stator housing, a vane-carrying rotor rotatable in the cylinder and forming a clearance seal portion with the cylinder, a first and a second air communication port, both the first and second air communication ports provided being positioned in only one of the end walls on the inside of the cylinder at opposite sides of the clearance seal portion, and the first and second air communication ports being respectively located at first and second opposite sides of the clearance seal portion, and the first and second air communication ports suppyling motive pressure air or scavengingexhaust air from the cylinder, a primary outlet located directly opposite the clearance seal portion, and a directional valve being shiftable between two positions for connecting alternatively the first and second air communication ports to the pressure air inlet passage and the exhaust air outlet passage, wherein:

auxiliary outlet ports are provided in the one of the end walls on the inside of the cylinder at angular positions between the primary outlet and each one of the first and second air communication ports, and the directional valve comprises control members which open and close communication between said auxiliary outlet ports and the exhaust air outlet passage when the directional valve is shifted from one of its positions to the other.

2. The vane motor according to claim 1, wherein said control members of the directional valve are arranged such that one of said auxiliary outlet ports provided on one side of the primary outlet is opened to the exhaust air outlet passage at the same time as the one of the first and second air communication ports on the same side of the primary outlet is connected to the exhaust air outlet passage, whereat another of said auxiliary outlet ports provided on the other side of the primary outlet is closed.

3. The vane motor according to claim 1, wherein each of the auxiliary outlet ports comprises two openings.

4. The vane motor according to claim 1, wherein the auxiliary outlet ports are located such that, during rotation of the vane-carrying rotor, a vane of the vane-carrying rotor passes one of the auxiliary outlet ports before a next vane of the vane-carrying rotor passes the primary outlet.

* * * * *